US010068729B2

(12) United States Patent
Shimoyama et al.

(10) Patent No.: US 10,068,729 B2
(45) Date of Patent: Sep. 4, 2018

(54) SWITCH DEVICE

(71) Applicants: FUJI ELECTRIC FA COMPONENTS & SYSTEMS CO., LTD., Chuo-ku, Tokyo (JP); CHICHIBU FUJI CO., LTD., Chichibu-gun, Saitama (JP)

(72) Inventors: Eijirou Shimoyama, Saitama (JP); Yoshihiro Takano, Saitama (JP); Noriyoshi Machida, Kounosu (JP)

(73) Assignees: FUJI ELECTRIC FA COMPONENTS & SYSTEMS CO., LTD., Tokyo (JP); CHICHIBU FUJI CO., LTD., Chichibu-Gun, Saitama (JP)

( * ) Notice: Subject to any disclaimer, the term of this patent is extended or adjusted under 35 U.S.C. 154(b) by 0 days.

(21) Appl. No.: 15/481,070

(22) Filed: Apr. 6, 2017

(65) Prior Publication Data

US 2017/0213672 A1 Jul. 27, 2017

Related U.S. Application Data

(63) Continuation of application No. 14/815,274, filed on Jul. 31, 2015, now Pat. No. 9,653,235, which is a (Continued)

(30) Foreign Application Priority Data

Feb. 4, 2013 (JP) ..... 2013-019361

(51) Int. Cl.
*H01H 13/14* (2006.01)
*H01H 25/00* (2006.01)
(Continued)

(52) U.S. Cl.
CPC ..... *H01H 25/008* (2013.01); *H01H 3/022* (2013.01); *H01H 13/14* (2013.01);
(Continued)

(58) Field of Classification Search
CPC .... H01H 11/0012; H01H 13/506; H01H 9/22; H01H 3/022; H01H 13/62; H01H 13/503;
(Continued)

(56) References Cited

U.S. PATENT DOCUMENTS 6,198,058 B1 * 3/2001 Graninger ..... H01H 13/02 200/16 R
7,186,932 B2 3/2007 Ishii et al.
(Continued)

FOREIGN PATENT DOCUMENTS

CN 201060808 Y 5/2008
EP 1553609 A1 7/2005
(Continued)

OTHER PUBLICATIONS

PCT, "International Search Report for International Application No. PCT/JP2013/083155".
(Continued)

*Primary Examiner* — Ahmed Saeed
(74) *Attorney, Agent, or Firm* — Manabu Kanesaka

(57) ABSTRACT

A switch device includes an operation unit, a switch unit detachably attached to the operation unit, and an engagement portion provided at the operation unit. The switch unit includes an opening-closing contact mechanism opened in association with an operation of the operation unit, and a drive portion driving the opening-closing contact mechanism to an open condition at a standby position and to a closed condition at a usage position. When the operation unit is attached to the switch unit, the engagement portion engages the drive portion to drive the drive portion from the standby position to the usage position. When the operation unit is inserted to the switch unit, the operation unit and the switch unit are engaged at the usage position.

12 Claims, 13 Drawing Sheets

Related U.S. Application Data continuation of application No. PCT/JP2013/083155, filed on Dec. 11, 2013.

(51) Int. Cl.
*H01H 3/02* (2006.01)
*H01H 13/62* (2006.01)

(52) U.S. Cl.
CPC ..... *H01H 13/62* (2013.01); *H01H 2221/01* (2013.01); *H01H 2221/036* (2013.01)

(58) Field of Classification Search
CPC .. H01H 19/6355; H01H 1/2083; H01H 13/14; H01H 13/18; H01H 19/03; H01H 19/14; H01H 2221/036
USPC ..... 200/43.04, 43.07, 334, 341, 336, 50.02, 200/338

See application file for complete search history.

(56) References Cited

U.S. PATENT DOCUMENTS

| | | | | |
|---|---|---|---|---|
| 2005/0284742 | A1* | 12/2005 | Ishii ..... | H01H 3/001 200/341 |
| 2010/0243418 | A1 | 9/2010 | Machida et al. | |
| 2011/0168536 | A1 | 7/2011 | Chauvet et al. | |

FOREIGN PATENT DOCUMENTS

| | | | |
|---|---|---|---|
| EP | 1553609 | B1 | 7/2008 |
| JP | H01-241723 | A | 9/1989 |
| JP | 2000-340062 | A | 8/2000 |
| JP | 2004-103363 | A | 4/2004 |
| JP | 2004-220827 | A | 8/2004 |
| JP | 2009-193812 | A | 8/2009 |
| JP | 2010-232157 | A | 10/2010 |

OTHER PUBLICATIONS

Europe Patent Office, "Search Report for European Patent Application No. 17164697.9," dated Jul. 19, 2017.
China Patent Office, "Office Action for Chinese Patent Application No. 201710199455.4," dated Jul. 4, 2018.

* cited by examiner

SWITCH DEVICE

CROSS-REFERENCES TO RELATED APPLICATIONS

This is continuation application of Ser. No. 14/815,274 filed on Jul. 31, 2015, which is a PCT International Application No. PCT/JP2013/083155 filed Dec. 11, 2013, which claims priority of Japanese Patent Application No. 2013-019361 filed Feb. 4, 2013, the disclosure of which is incorporated herein.

TECHNICAL FIELD

The invention relates to a switch device, in which an operation unit used in a state of attachment to a panel, or the like, and a switch unit, in which an opening-closing contact is opening-closing operated by the operation unit, are structured to be separable from each other.

BACKGROUND ART

For example, Patent Literature 1 describes a known switch device in which an operation unit and a switch unit operated by the operation unit are structured to be separable.

A conventional switch device 1 described in Patent Literature 1 is depicted in FIGS. 12 to 14.

A switch device 100 is provided with an operation unit 110 and a switch unit 120 which are structured mutually attachable and detachable. The operation unit 110 transmits a pushing operating force, which is applied from the outside, to the switch unit 120. The switch unit 120 receives the operating force from the operation unit 110 and opens/closes a plurality of opening/closing contact portions on the basis of the operating force.

The operation unit 110 is provided with an operation unit main body 111 and a pushbutton 113. The pushbutton 113 has a substantially round columnar shape, and the upper end surface of the pushbutton 113 receives the operating force from the outside in the axial direction. A protrusion 114 having a round columnar shape is provided in a protruding condition at the side surface on the lower end side of the pushbutton 113. Two guide grooves 112 having a substantially inverted L-shape are provided facing each other on the lower side of the side surface of the operation unit main body 111 for allowing the operation unit main body 111 to be rotated and fitted into the switch unit 120.

The pushbutton 113 of the operation unit 110 is supported by the operation unit main body 111 such that the pushbutton can move in the axial direction and cannot rotate in the rotation direction. As depicted in FIG. 14, a lock pin 116 which is caused by the urging force of a spring 115 to protrude from the inner wall of the operation unit main body 111 is provided at the operation unit main body 111, and a locking protrusion 117 which is to be engaged with the lock pin is provided in a protruding condition at the side surface of the pushbutton 113. As a result, when the upper surface of the pushbutton 113 is pushed down along a central axial line X by an operating force equal to or greater than a predetermined value, the lock pin 116 of the main body 111 is pushed in by the locking protrusion 117 against the urging force of the spring 115, and the pushbutton 113 moves downward to release the engagement of the locking protrusion 117 and the lock pin 116. When the locking protrusion 117 rides over the lock pin 116, the lock pin 116 protrudes and engages with the locking protrusion 117 again, and the pushbutton 113 is locked at a pushing position shown by a dot line (FIG. 14).

The switch unit 120 is provided with a partition wall 123 partitioning the inner space of a switch unit main body 121 in the horizontal direction, and a through hole 124 passing through along the central axial line X is provided in the central portion of the partition wall. Two engagement protrusions 122 to be engaged with the guide groove 112 of the operation unit 110 are integrally formed on the inner wall of the switch unit main body 121 above the partition wall 123.

A contact shaft 125 is inserted into the through hole 124 such that the contact shaft can move in the direction of the central axial line X, but cannot rotate about the central axial line X. A tubular pushbutton receptacle 126 into which the lower end portion of the pushbutton 113 is to be inserted from above is provided at the upper end of the contact shaft 125. A helical cut-out guide 127 which extends downward, while turning about the central axial line X, as shown in the figure, is provided in the circumferential side surface of the pushbutton receptacle 126 in order to engage with the protrusion 114 of the pushbutton 113.

An opening-closing contact mechanism 130 is accommodated in a space below the partition wall 123 in the switch unit main body 121. The opening-closing contact mechanism 130 is provided with a pair of fixed contactor pieces 132, each movable contactor piece being provided with a fixed contact 133, and a movable bridging piece 134 provided with a pair of movable contacts 135 at both ends. A distal end of the contact shaft 125 is joined to the central portion of the movable bridging piece 134, and a contact spring 131 that urges the movable bridging piece 134 in the direction of separating from the fixed contactor pieces 132 is attached to the contact shaft 125 between the movable bridging piece 134 and the partition wall 123. An external connection terminal piece 136 is drawn out to the outside of the main body 121 from each of the fixed contactor pieces 132. The fixed contact 133 of the fixed contactor piece 132 and the movable contact 135 of the movable bridging piece 134 are provided facing each other to enable contact and separation thereof.

The operation unit 110 is mounted on a panel (not shown in the figure).

In a state in which the switch unit 120 is separated from the operation unit 110, as depicted in FIG. 12, the movable bridging piece 134 is pulled apart from the fixed contactor pieces 132 by the contact spring 131, so that the contact shaft 125 moves downward, and the movable contacts 135 and the fixed contacts 133 are in a state (switch-off) separated from each other.

When the switch unit 120 is to be joined to the operation unit 110 from this state, initially, the switch unit 120 is fitted from below into the operation unit 110 so that the engagement protrusion 122 of the switch unit 120 is inserted into an inlet port of the guide groove 112 of the operation unit 110 and the protrusion 114 is inserted into an inlet port of the cut-out guide 127 of the switch unit.

Then, the switch unit main body 121 is turned in the direction of an arrow R (to the right) about the central axial line X. Since the pushbutton 113 is arranged to be incapable of rotating with respect to the operation unit main body 111, when the switch unit main body 121 is turned in the direction of arrow R, the protrusion 114 moves inside the helical cut-out guide 127. As a result, the protrusion 114 moves the pushbutton receptacle 126 upward, and following this movement, the movable contact 135 also moves upward, but when the switch unit main body 121 is stopped from turning, the movable contact 135 becomes a state (switch-on) contacting the fixed contact 133 (see FIG. 13(*a*)). The switch unit 120 is thus joined and fixed to the operation unit 110.

To detach the switch unit 120 from the operation unit 110, a procedure reversed to the procedure used to attach the switch unit 120 to the operation unit 110 is implemented. Thus, in a state in which the switch unit 120 depicted in FIG. 13(*a*) is attached to the operation unit 110, the switch unit 120 is turned in the direction of arrow L (to the left) about the central axial line X, the units are disconnected, and the switch unit 120 is detached from the operation unit 110 by further pulling downward (see FIG. 12). In this state, the movable contacts 135 and the fixed contacts 133 are urged by the contact spring 131 in the separation direction and separated from each other, and the open (switch-off) state is maintained.

With the switch device 100 having such an arrangement, in a standby state, the movable contacts 135 and the fixed contacts 133 are closed at all times and the switch-on state is maintained, as depicted in FIG. 13(*a*).

When the pushbutton 113 of the operation unit 110 is pushed down in this state, the movable bridging piece 134, which is linked to the pushbutton through the pushbutton receptacle 126 and the contact shaft 125, is lowered. Therefore, the movable contacts 135 are separated from the fixed contacts 133 and become the switch-off state (see FIG. 13(*b*)). As a result, when the switch device is used as an emergency switch, a stop command can be applied to the control object. In this case, since the pushbutton 113 is locked by the lock pin 116 at a position in which the locking protrusion 117 rides over the lock pin 116 at the pushing operation position shown by a dot line in FIG. 14, the pushbutton is held at the pushing operation position and maintained in the OFF state in which the movable contacts 135 are separated from the fixed contacts 133.

When an accident occurs such that the switch unit 120 joined to the operation unit 110 is detached from the operation unit 110, the movable contacts 135 of the switch unit 120 are urged by the return spring 131 in the separation direction and automatically separated from the fixed contacts 133 that have been in a closed state at all times, becoming a switch-off state (the state identical to the operation state). Therefore, when the switch device is used as an emergency stop switch, an accident causing the switch unit 120 to detach from the operation unit 110 results in a switch-off state. As a result, a stop command is issued to the control object and safety of the control object can be maintained.

Patent Literature 1: Japanese Patent Application Publication No. 2004-103363

DISCLOSURE OF THE INVENTION

In the aforementioned conventional switch device, the movable contacts of the opening-closing contact mechanism are urged at all times by the contact spring that urges in the direction such that the opening-closing state of the opening-closing contact is the opening-closing state at the time of the operation state, that is, in the direction in which the movable contacts and the fixed contacts are separated from each other in the case of a normally closed contact arrangement, or in the direction in which the movable contacts and the fixed contacts are closed in the case of a normally open contact arrangement.

Therefore, the problem associated with a switch device having a normally closed contact arrangement such that the opening-closing contacts are closed in the standby state is that when a slight impact force is applied to the switch unit 120, or the joined state of the switch unit 120 and the operation unit 110 becomes loose, the contact shaft 125 and the movable bridging piece 134 supporting the movable contacts 135 are pushed downward by the contact spring 131, the movable contacts 135 are separated from the fixed contacts 133, and an erroneous operation such as a switch-off operation can be temporarily performed.

In the switch device having a normally open arrangement such that the opening-closing contacts are open in the standby state, an impact force can erroneously close the fixed contacts with the movable contacts, regardless of the operator's intentions, thereby causing a switch-on state.

The invention is provided to resolve the aforementioned problems, and it is an objective of the invention to provide a switch device with a high operation reliability in which opening-closing contact portions are not erroneously opened or closed even when an impact is applied to the switch device from the outside.

In order to resolve the problems, the invention provides a switch device including an operation unit having a pushbutton for performing a pushing operation, and a switch unit detachably attached to the operation unit and equipped with an opening-closing contact mechanism opened or closed in conjunction with the pushing operation of the pushbutton of the operation unit.

The switch unit is provided with a rotary drive plate which rotates between a standby position and a usage position. In the standby position, the switch unit drives the opening-closing contact mechanism to be in an opening-closing state where the operation unit is in an operation state, and in the usage position, the switch unit drives the opening-closing contact mechanism to be in an opening-closing state where the operation unit is in a standby state. The operation unit is provided with an engagement portion engaged to the rotary drive plate to rotary-drive the rotary drive plate from the standby position to the usage position when the operation unit is joined and attached to the switch unit. The operation unit is attached to or detached from the switch unit to set the opening-closing contact mechanism to respectively predetermined opening-closing states.

In the embodiment, the opening-closing contact mechanism may be provided with a contact spring that urges an opening-closing contact of the opening-closing contact mechanism in a direction to be in an opening-closing state where the operation unit is in the standby state.

The rotary drive plate can be provided, at one end thereof, with a cam piece that drives the opening-closing contact mechanism.

Further, the rotary drive plate of the switch unit can be also provided with a return spring that returns the rotary drive plate from the usage position to the standby position when the switch unit is separated from the operation unit.

Further, the engagement portion engaging the rotary drive plate with the operation unit includes an engagement groove provided at the operation unit or the rotary drive plate and inclined in an axial direction and an engagement protrusion provided at the rotary drive plate or the operation unit so as to be engaged with the engagement groove.

According to the invention, the switch unit, which is separably joined to the operation unit, is provided with a rotary drive plate which rotates between a standby position and a usage position, operates the opening-closing contact mechanism in the standby position to an opening-closing state where the operation unit is in an operation state, and operates the opening-closing contact mechanism in the usage position to an opening-closing state where the operation unit is in a standby state. The operation unit is arranged to be engaged with the rotary drive plate and rotary-drive the rotary drive plate from the standby position to the usage position when the operation unit is joined and attached to the switch unit. Therefore, the opening-closing contact mechanism can be set to a respective predetermined opening-closing state by detaching or attaching the operation unit from or to the switch unit. As a result, if by any chance an accident occurs such that causes the operation unit to separate from the switch unit, the opening-closing state of the opening-closing contact mechanism can be obtained as the opening-closing state where the operation unit is in the operation state. The switch device thus can be used as an emergency safety device.

Further, the opening-closing contacts of the opening-closing contact mechanism are urged at all times in the direction to be in the opening-closing state at the time the operation unit is in the standby state, that is, in the direction in which the movable contacts and the fixed contacts are closed in the case of a normally closed contact structure and in the direction in which the movable contacts and the fixed contacts are separated from each other in the case of a normally open contact structure. Therefore, even when an impact is applied to the switch device in the standby state, the movable contacts are unlikely to move. As a consequence, erroneous operation is prevented and operation reliability of the switch device can be increased.

DETAILED DESCRIPTION OF THE INVENTION

An embodiment of the invention will be explained hereinbelow in detail with reference to the drawings.

FIGS. 1 to 11 depict an example of the switch device to be used as a pushbutton switch for emergency stop in accordance with the present embodiment.

Figure 1:
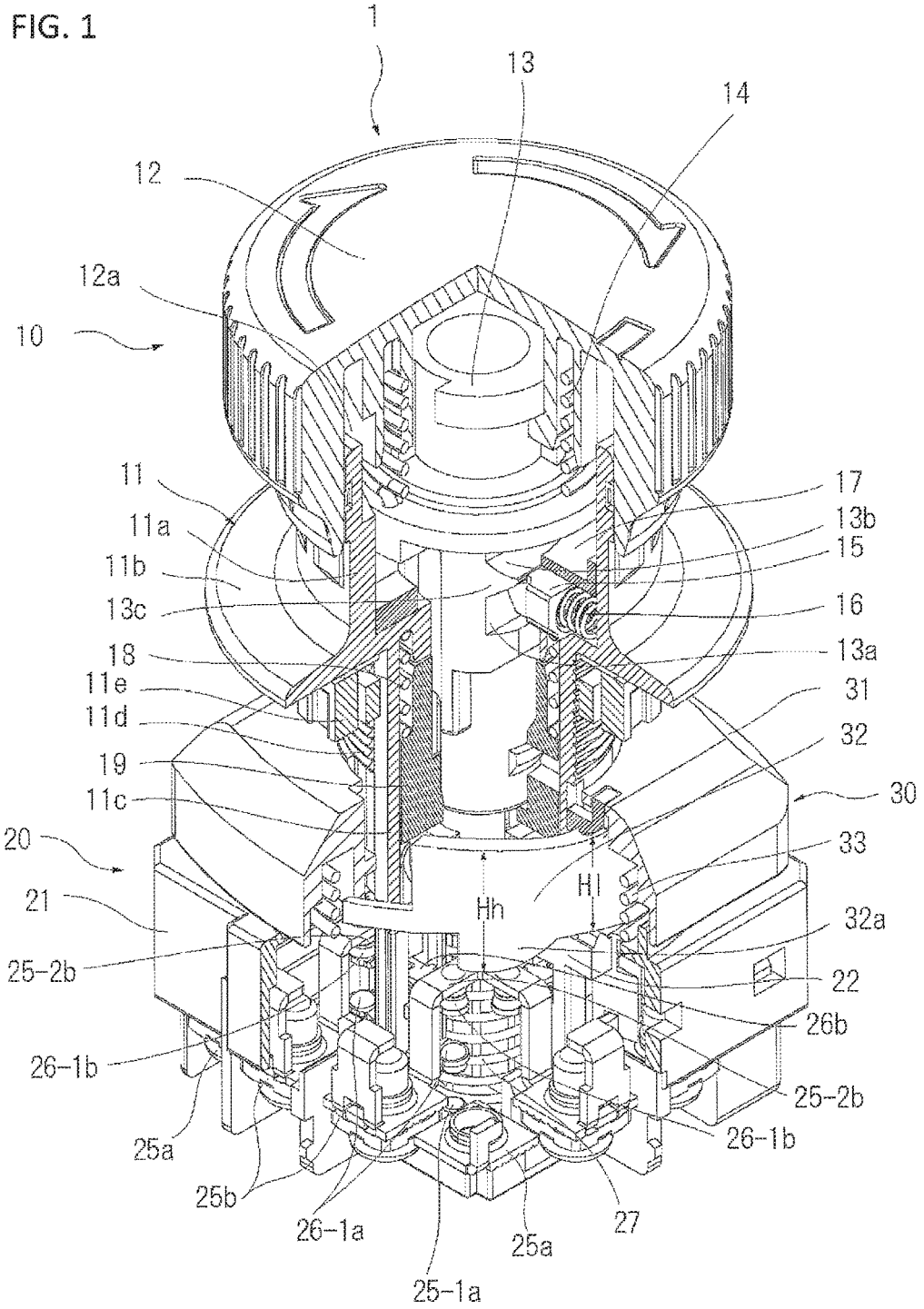
FIG. 1 is a partially cut-out perspective view illustrating the entire structure of the switch device of a present embodiment.

In FIG. 1, the reference numeral 1 refers to a switch device provided with an operation unit 10 and a switch unit 20 which are arranged to be joinable to each other and separable from each other.

The operation unit 10 transmits an external operating force to the switch unit 20 and opens/closes an opening/closing contact mechanism located inside the switch unit 20. The operation unit includes a pushbutton 12 and an operation unit main body 11 that supports the pushbutton.

Figure 2A:
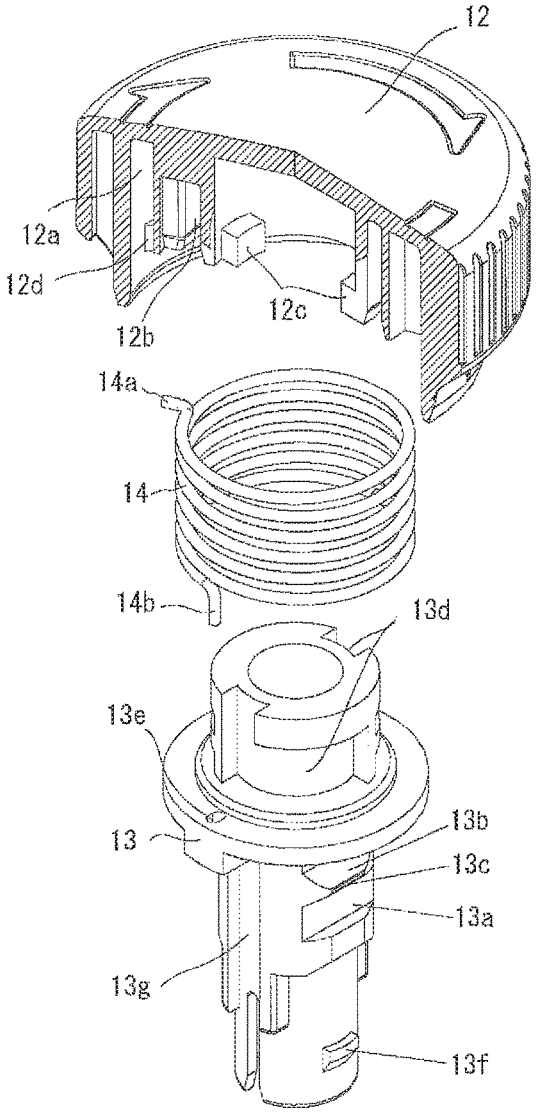
FIGS. 2(*a*), 2(*b*) depict the structure of the pushbutton portion of the present embodiment, wherein FIG. 2(*a*) is a partially cut-out exploded perspective view and FIG. 2(*b*) is a partially cut-out perspective view of the assembled state.
Figure 2B:
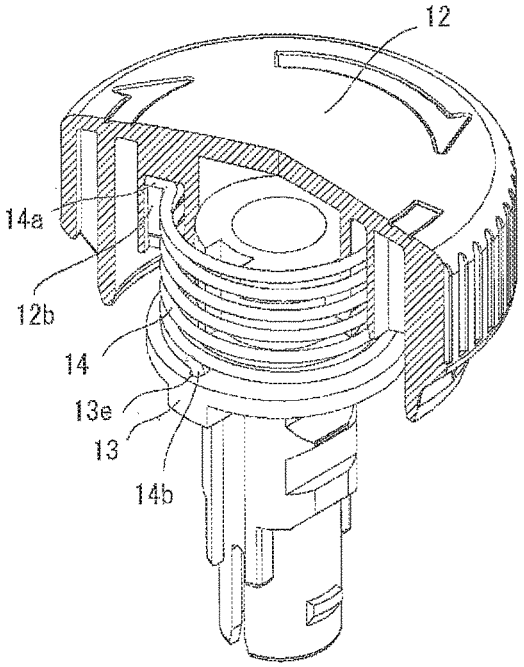
Figure 3:
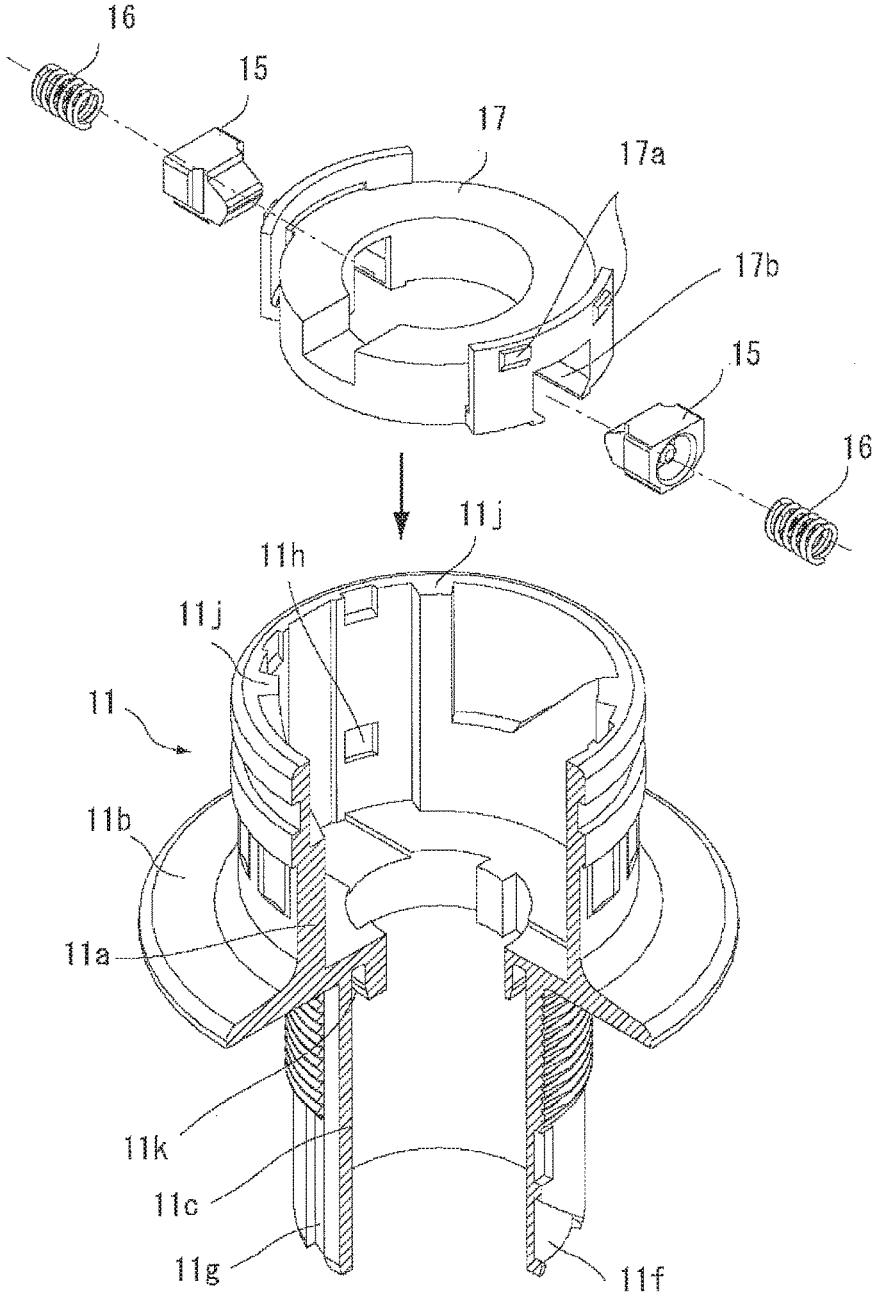
FIG. 3 is a partially cut-out exploded perspective view of the structure of the operation unit main body of the present embodiment.

As shown in detail in FIG. 2, the pushbutton 12 is assembled with a push rod 13 through a pushbutton return spring 14 constituted by a twisted coil spring.

When the aforementioned components are assembled, initially, a bent portion 14*a* at one end of the return spring 14 is inserted in and engaged with an engagement groove 12*b* of the pushbutton 12. A distal end portion of the push rod 13 is inserted into the spring 14 engaged with the pushbutton 12, and a bent portion 14*b* at the other end of the spring 14 is inserted in and engaged with a fixing hole 13*e* of the push rod 13. In this state, the pushbutton 12 is rotated rightward, a pair of engagement protrusions 12*c* located inside the pushbutton 12 is aligned with a pair of L-shaped engagement grooves 13*d* on the outer circumference of the distal end portion of the push rod 13, and then the push rod 13 is inserted into the pushbutton 12, and the engagement protrusions 12*c* and the engagement grooves 13*d* are engaged with each other. As a result, the pushbutton 12 and the push rod 13 are joined through the return spring 14 so as to be rotatable relative to each other within a predetermined angular range, as depicted in FIG. 2(*b*).

Figure 4:
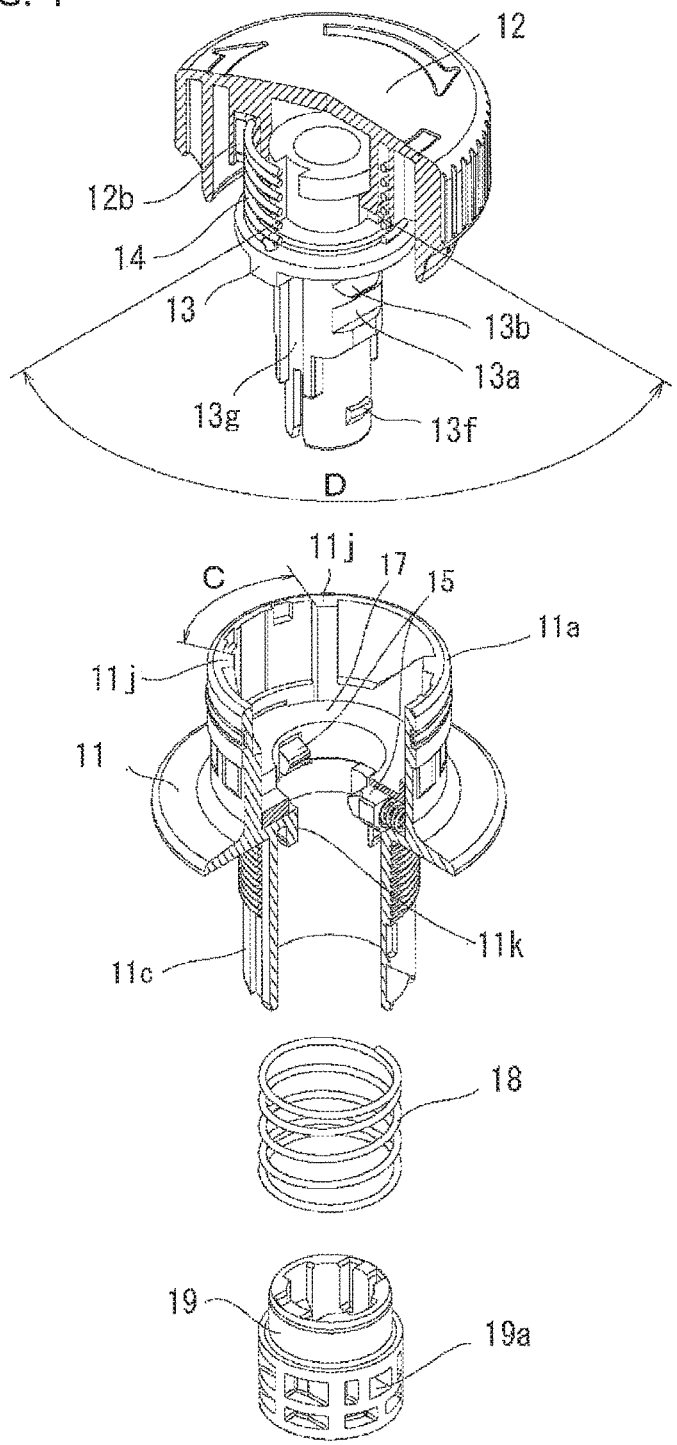
FIG. 4 is a partially cut-out exploded perspective view of the structure of the operation unit of the present embodiment.

The operation unit 10 is formed by joining the operation unit main body 11 to the pushbutton 12 of the above-described structure. As shown in detail in FIG. 3, a lock holder 17 provided with a pair of holding grooves 17*b* is inserted into the operation unit main body 11. A lock pin 15 and a lock spring 16 are inserted into the respective holding grooves 17*b* of the lock holder 17 and held therein. The lock holder 17 inserted into the operation unit main body 11 is pushed in until the engagement protrusion 17*a* is engaged with an engagement hole 11*h* provided in the inner wall of a cylindrical upper body portion 11 of the operation unit main body 11, thereby fixing the lock holder 17 to the operation unit main body 11. The lock pin 15 held in the lock holder 17 which has been fixed inside the operation unit main body 11 is elastically pushed by the lock spring 16, and the distal end of the lock pin 15 protrudes toward the inner side of the lock holder 17, as depicted in FIG. 4.

The assembly of the pushbutton 12, the push rod 13, and the return spring 14 is inserted from above into the operation unit main body 11. In this case, the lock pin 15 which is pressed inward by the lock spring 16 on the main body side pushes the push rod 13 such as to ride over the receding-protruding section on the outer circumference of the push rod 13 and be locked in a first recess 13a for locking. Then, a trigger spring 18 and a push body 19 are inserted from below into the operation unit main body 11, an engagement hole 19a in the push body 19 is engaged with an engagement protrusion 13f at the lower end side of the push rod 13, the main body 11 and the pushbutton 12 are integrally joined, and the operation unit 10 is formed.

The operation unit main body 11 and the pushbutton 12 are joined to be capable of moving in the axial direction and rotation direction with respect to each other. However, since two rotation suppressing protrusions 11*j* are provided with a spacing of angle C on the inner side of the upper portion of the operation unit main body 11, and a rotation suppressing protrusion 12*d* corresponding thereto and located on the pushbutton 12 is fitted between the two protrusions 11*j*, the range of rotation of the pushbutton 12 relative to the operation unit main body 11 is restricted to the range of angle C. Further, when the push rod 13 is inserted into the operation unit main body 11, a rotation preventing protrusion 11*k* provided inside the operation unit main body 11 correspondingly to a rotation preventing groove 13*g* provided in the axial direction on the outer circumference of the push rod engages with the rotation preventing groove 13*g*, thereby preventing the push rod 13 from rotating relative to the operation unit main body 11 and allowing only the vertical (axial) movement.

The engagement of the engagement protrusion 12*c* of the pushbutton 12 with the L-shaped engagement groove 13*d* of the push rod 13 allows the pushbutton 12 to be rotated within a range of a rotation angle D (see FIG. 4) relative to the push rod 13, but in a range of angle C in which the rotation relative the operation unit main body 11 can be performed, the pushbutton 12 is stopped by the L-shaped engagement groove 13*d* of the push rod 13.

In the operation unit 10 having such a structure, in a standby state before the pushbutton 12 is pushed, the return spring 14 pushes up the pushbutton 12, and the lock pin 15 is engaged with the first recess 13*a* provided on the outer circumference of the intermediate portion of the push rod 13, thereby locking the push rod 13 in this position. Therefore, the pushbutton 12 is held, this position serving as a standby position. The lock pin 15 is supported by the lock holder 17 through the lock spring 16 to be radially retractable inside the operation unit main body 11.

When the pushbutton 12 is pushed axially by a predetermined force or a stronger force, the push rod 13 receives this force and the inclined upper wall of the recess 13a pushes the lock pin 15 in the outer circumferential direction against the lock spring 16, thereby releasing the engagement of the recess 13*a* and the lock pin 15, and pushing the push rod 13 over the lock pin 15. The lock pin 15 that came out of the recess 13*a* engages with a second recess 13*b* in the upper portion of the recess 13*a* and holds the pushbutton 12 and the push rod 13 in the pushing operation position thereof.

The push rod 13 is arranged to push down the push body 19, which is linked to a movable contactor holder 22 of the switch unit through the trigger spring 18, by such a pushing operation. The lower end of the push body 19 hits the upper end of the movable contactor holder 22 of the switch unit 20, pushes the movable contactor holder down, and opens/closes the opening-closing contact mechanism of the switch unit 20 (see FIG. 1).

Further, a fixing thread 11*d* is provided on the outer circumference of the body portion 11*c* below a flange portion lib of the operation unit main body 11. A fastening nut 11*e* is screwed onto the thread 11*d* to fasten and fix the operation unit 10 to a panel such as a control panel. An axial engagement groove 11*f* (see FIG. 6) for connecting and engaging the operation unit 10 and the switch unit 20 is provided on the outer circumference on the lower end side of the body portion 11*c* of the operation unit main body 11. As shown in detail in FIGS. 9(*a*)-9(*d*), the engagement groove 11*f* is provided with an axial inclined portion 11*f*-1 which rises obliquely from a lower end to the upper left side, a horizontal portion 11*f*-2 which is connected at the upper end of the inclined portion 11*f*-1 and extends in the horizontal direction, and a vertical portion 11*f*-3 that is connected at the right end of the horizontal portion 11*f*-2 and extends slightly upward in the vertical direction.

Figure 6:
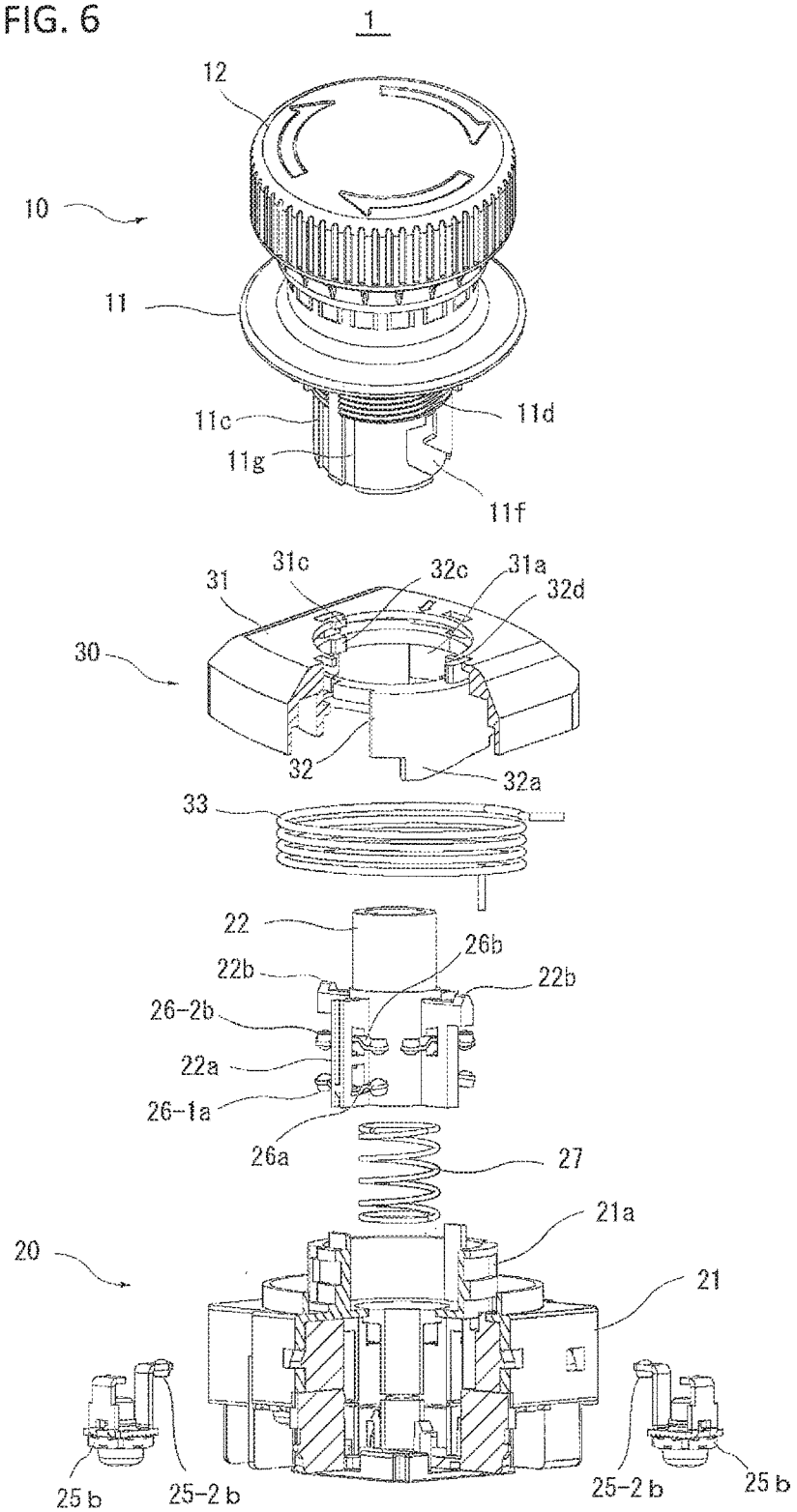
FIG. 6 is an exploded perspective view of the switch device of the present embodiment.

An engagement groove 11g for engagement with an engagement ridge 21*b* extending axially at the inner circumference of a cylindrical portion 21*a* of a switch unit main body 21 of the switch unit 20 is additionally provided at the outer circumference of the lower body portion 11*c* of the operation unit main body 11 (see FIG. 6).

The switch unit 20 that is detachably connected to such an operation unit 10 is explained below.

As depicted in FIGS. 1 and 6, the switch unit 20 is provided with the rectangular box-shaped switch unit main body 21. The main body 21 is provided with at least one pair of fixed contacts 25-1*a*, 25-2*b* integrally connected to each pair of output terminals 25*a*, 25*b* that is fixedly disposed at the lower end side of the main body. The references with the letter (a) attached thereto represent normally open contacts which are usually open, that are, the contacts constituting the so-called (a) contacts, and the references with the letter (b) attached thereto represent normally closed contacts which are usually closed, that are, the contacts constituting the so-called (b) contacts.

Further, as shown in detail in FIG. 6, the movable contactor holder 22 that holds movable contactors 26*a*, 26*b* in the form of bridging pieces provided with a pair of movable contacts 26-1*a*, 26-2*b* at the two ends is accommodated movably in the vertical direction inside the main body 21 through a contact spring 27 imparting an urging force to the contacts. The normally open movable contact 26-1*a* and the normally closed movable contact 26-2*b* held by the movable contactor holder 22 are disposed facing the normally open fixed contact 25-1*a* and the normally closed fixed contact 25-2*b*, and form the opening-closing contact mechanism. In this case, the contact spring 27 is formed from a compressive coil spring and generates an urging force in the direction pushing the movable contactor holder 22 upward. As a result, when the pushbutton 12 is in the usual standby state (state in which the pushbutton 12 is not pushed), as depicted in FIG. 1, the normally open movable contact 26-1*a* which is held by the movable contactor holder 22 is placed in a state of separation from the fixed contact 25-1*a*, and the normally closed movable contact 26-2*b* is placed in a state of contacting the fixed contact 25-2*b*. This is the opening-closing state of the opening-closing mechanism at the time the operation unit is in the standby state.

Figure 7:
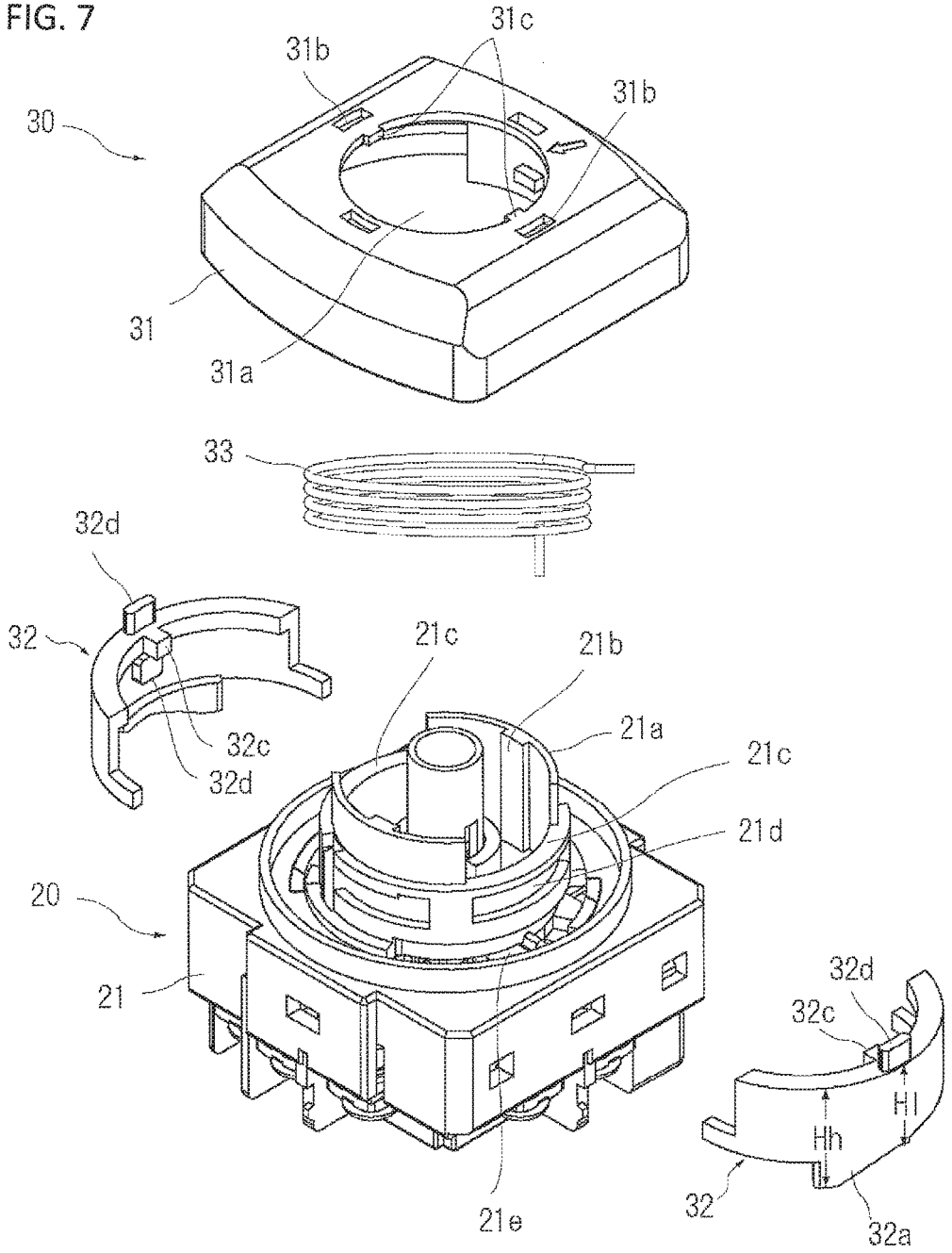
FIG. 7 is an exploded perspective view of the switch unit of the switch device of present embodiment.

Further, as depicted in FIGS. 6 and 7, the cylindrical portion 21*a* having cut-out portions 21*c* in parts thereof, the cut-out portions 21*c* facing each other, is formed protruding at the upper portion of the switch unit main body 21 in order to join a rotary drive portion 30.

Figure 8:
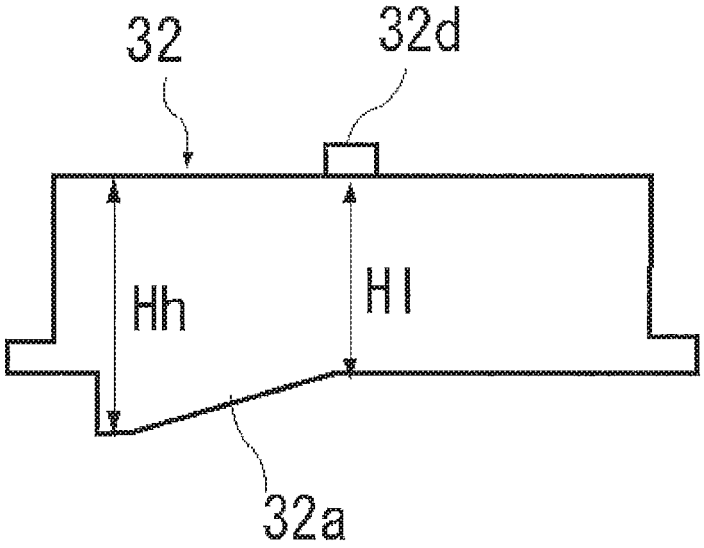
FIG. 8 is a front view of the rotary drive plate used in the switch device of the present embodiment.
Figure 9A:
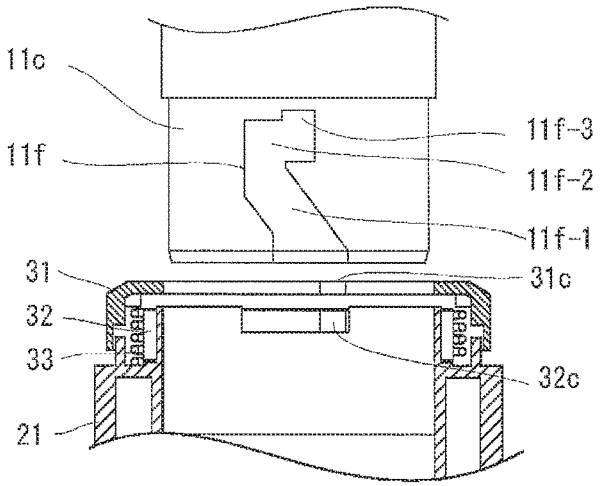
FIGS. 9(*a*)-9(*d*) illustrate the process of joining the operation unit and switch unit of the switch device of the present embodiment.
Figure 9B:
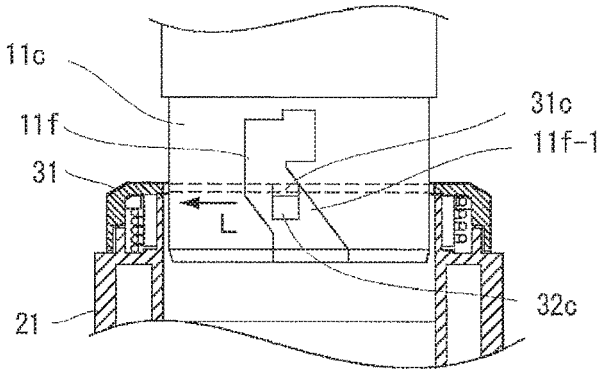
Figure 9C:
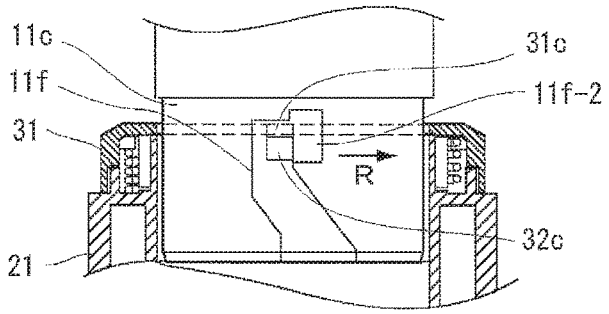
Figure 9D:
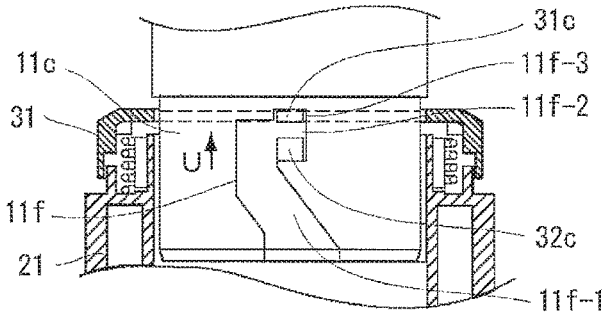

The rotary drive portion 30 is provided with a rotary cover 31, a rotary drive plate 32, and a rotary drive spring 33. Engagement protrusions 32*b* formed at the inner circumferential side of the rotary drive plate 32, which is formed to be split in two substantially semicylindrical portions, are inserted in and engaged with a pair of semicircular-arc grooves 21*d* formed at the outer circumference of the cylindrical portion 21*a* of the switch unit main body 21, thereby rotatably supporting the rotary drive plate 32 with the cylindrical portion 21*a*. A cam piece 32*a* having a cam surface inclined in the circumferential direction is partially formed at the lower end of the rotary drive plate 32. As shown in FIG. 8, the cam piece 32*a* has at the lower end thereof an inclined cam surface which connects together a position with a larger height Hh and a position with a smaller height H1 from the upper end of the rotary drive plate 32. The cam piece 32*a* penetrates into the main body through a through hole 21*e* (see FIG. 7) in the upper wall of the switch unit main body 21, and the cam surface is joined to the upper surface of a pressure-receiving piece 22*b* that is formed in a protruding condition on the outer circumferential side of the movable contactor holder 22 that holds the movable contacts 26-1*a*, 26-2*b* (see FIGS. 1 and 6).

The rotary drive plate 32 supported by the cylindrical portion 21*a* of the switch unit main body 21 is covered from above with the rotary cover 31. The rotary drive spring 33 formed from a twisted coil spring is inserted between the rotary cover 31 and the rotary drive plate 32, and the two ends of the rotary coil spring are engaged. For this purpose, a round fitting hole 31*a* that fits the cylindrical portion 21*a* of the switch unit main body 21 is provided in the central portion of the rotary cover 31, and a fitting hole 31*b* that fits the upper protrusion 32*d* of the rotary drive plate 32 is provided outside the round fitting hole 31*a*. Further, a protrusion 31*c* engaging with the engagement groove 11*f* provided in the lower body portion 11*c* of the operation unit main body is formed protruding at a position facing the inner circumference of the fitting hole 31*a*.

When the rotary cover 31 is covered on the rotary drive plate 32, the distal end portion of the cylindrical portion 21*a* of the switch unit main body 21 is loosely fitted to the fitting hole 31*a* of the rotary cover 31, and the rotary cover 31 is rotatably supported on the switch unit main body 21. Further, at this time, the protrusion 32*d* at the upper portion of the rotary drive plate 32 is fitted to the fitting hole 31*b* of the rotary cover 31, and the rotary cover 31 and the rotary drive plate 32 are joined integrally together. Therefore, the rotary cover 31 and the rotary drive plate 32 are integrally rotatably supported by the cylindrical portion 21*a* of the switch unit main body 21. The rotary drive spring mounted between the rotary cover 31 and the cylindrical portion 21*a* of the switch unit main body 21 is locked at one end to the cylindrical portion 21*a* and locked at the other end to the rotary cover 31, whereby elastic restoration forces are applied in the axial and rotation directions to the rotary cover 31 and the rotary drive plate 32.

Figure 10B:
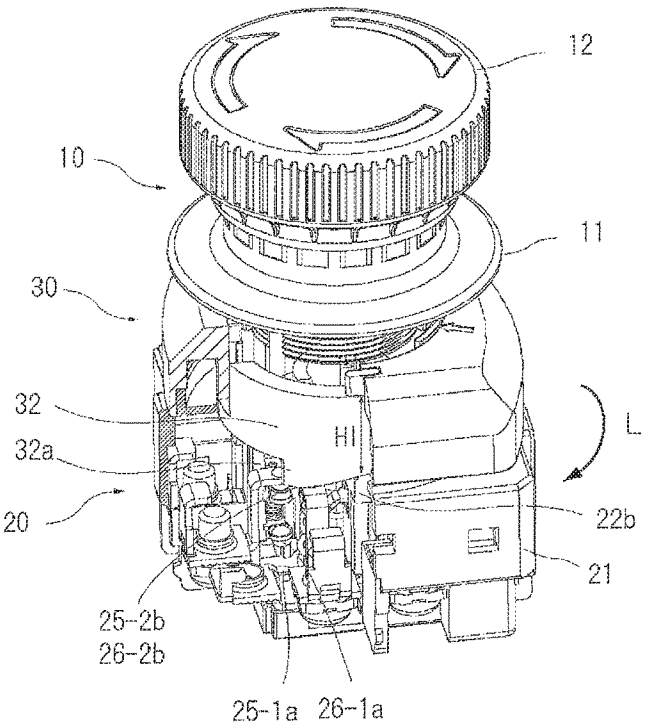
FIGS. 10(*a*), 10(*b*) illustrate the joined state of the operation unit and switch unit of the switch device of the present embodiment, wherein FIG. 10(*a*) depicts the state in which the operation unit and switch unit are separated, and FIG. 10(*b*) depicts the state in which the operation unit and switch unit are joined together.
Figure 10A:
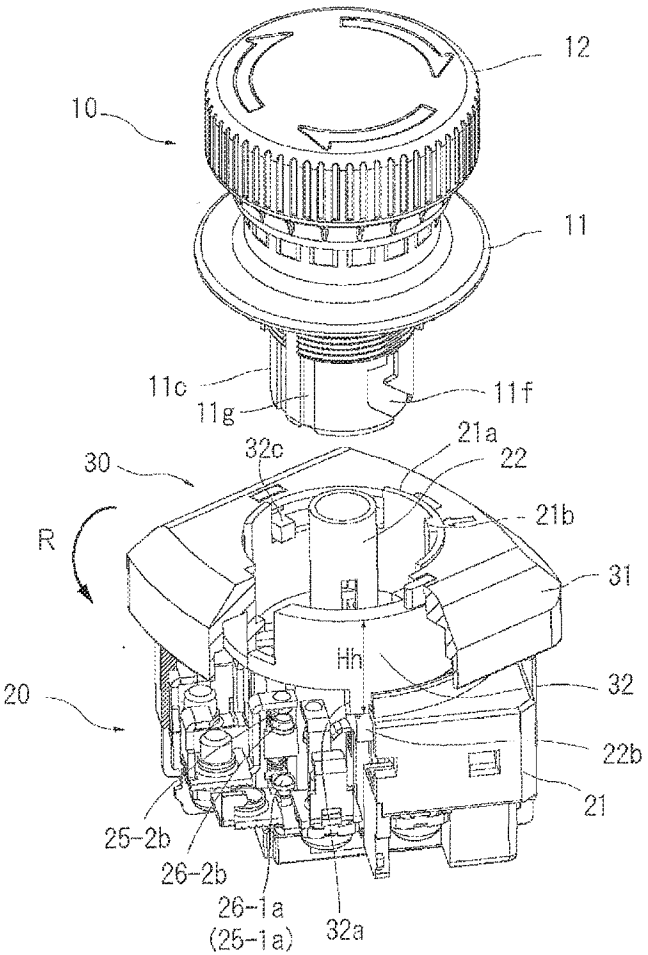

When the operation unit 10 and the switch unit 20 arranged in the above-described manner are separated from each other, as depicted in FIG. 10(*a*), the rotary drive portion 30 located on the switch unit main body 21 is rotated rightward, as shown by an arrow R, by the restoration force of the rotary drive spring 33 and placed at a standby position which is slightly shifted from the position of alignment with the switch unit main body 21. As a result, the rotary drive plate 32 located inside the rotary drive portion 30 is also placed at a standby position, and the cam piece 32*a* formed in a protruding state at the lower end of the rotary drive plate is joined to the pressure-receiving piece 22*b* of the movable contactor holder 22 at a position with the larger height Hh (see FIGS. 7 and 8). As a consequence, the movable contactor holder 22 is pushed deeply downward according to the height Hh of the cam piece 32*a* against the urging force of the contact spring 27. Therefore, in the opening-closing contact portion of an (a) contact arrangement, the normally open movable contact 26-1*a* contacts the normally open fixed contact 25-1*a* and becomes a switch-on state. In the opening-closing contact portion of a (b) contact arrangement, the normally open movable contact 26-2*b* separates from the normally open fixed contact 25-2*b*, and becomes a switch-off state. Such an opening-closing state of the opening-closing contact portion is the same as the opening-closing state at the time of the standby state of the operation unit in a state in which the operation unit 10 is joined to the switch unit 20.

The procedure by which the operation unit 10 is thus joined to the switch unit 20, in which the rotary drive portion 30 is placed at the standby position, to obtain the usage state will be explained hereinbelow with reference to FIGS. 9(*a*)-9(*d*).

The lower body portion 11*c* of the main body 11 of the operation unit 10 is inserted from above into the cylindrical portion 21*a* of the switch unit 20 in which the rotary drive portion 30 is placed at the standby position. For this purpose, initially, as depicted in FIG. 9(*a*), the protrusion 31*c* of the rotary cover 31, which protrudes inward of the cylindrical portion 21*a* of the switch unit main body 21, and the second protrusion 32*c* of the rotary drive plate 32 are fitted into the engagement groove 11*f* on the outer circumference of the lower body portion 11*c* of the operation unit main body 11. Then, the operation unit 10 and the switch unit 20 are aligned such that the ridge 21*b* provided at the cylindrical portion 21*a* of the main body 21 of the switch unit 20 is inserted into the engagement groove 11*g* of the operation unit main body 11.

Once such an alignment is attained, the lower body portion 11*c* of the operation unit main body 11 is inserted from above into the cylindrical portion 21*a* of the switch unit 20, in which the rotary drive portion 30 is placed at the standby position, and pushed down while the protrusions 31*c*, 32*c* are fitted to the engagement groove 11*f*, and the engagement ridge 21*b* is fitted to the engagement groove 11*g* (FIG. 9(*b*)). As the operation unit 10 is pushed, the protrusion 31*c* of the rotary cover 31 and the protrusion 32*c* of the rotary plate 32, which are fitted with the engagement groove 11*f*, are pushed by the inner wall of the inclined portion 11*f*-1 of the engagement groove 11*f* and moved leftward, as shown by an arrow L. Therefore, the rotary cover 31 and the rotary plate 32 are rotated to the left while twisting the rotary drive spring 33.

When the protrusion 31c of the rotary cover 31 and the protrusion 32*c* of the rotary plate 32 reach the horizontal portion 11*f*-2 of the engagement groove 11*f*, as shown in FIG. 9(*c*), the protrusions are rotated rightward, as shown by the arrow R, by the restoration force of the rotary drive spring 33 twisted by the rotation of the rotary cover 31 and the rotary plate 32. As a result, the protrusions 31*c* and 32*c* move to the right end of the horizontal portion 11*f*-2 of the engagement groove 11*f*. Further, since the rotary cover 31 is also driven upward by the axial restoration force of the rotary return spring 33, the rotary cover 31 rises and only the protrusion 31*c* of the rotary cover 31 moves into the vertical portion 11*f*-3 of the engagement groove 11*f*, as depicted in FIG. 9(*d*). As a result, the protrusion 31*c* of the rotary cover 31 is locked to the vertical portion 11*f*-3 of the engagement groove 11*f* of the operation unit 11. Therefore, the rotary drive portion 30 is fixed and cannot rotate with respect to the body portion 11*a* of the operation unit main body 10.

The operation unit 10 is thus inserted to the very end into the rotary drive portion 30, and becomes the usable state when the operation unit 10 is joined to the switch unit 20, as shown in FIG. 10(*b*). In this state, the rotary drive portion 30 is fixed in alignment with the usage position of the main body 21 of the switch unit 20. When the rotary drive portion 30 is placed at this position, the rotary plate 32 located inside thereof rotates leftward, as shown by the arrow L, together with the rotary drive portion 30. Therefore, the joining position of the rotary drive plate 32 and the pressure-receiving piece 22*b* of the movable contactor holder 22 of the switch unit 20 becomes a low position with the height H1 of the cam piece 32*a*, and the movable contactor holder 22 is pushed up to the position with the height H1 of the cam piece 32*a* by the contact spring 27. As a result, the normally open movable contact 26-1*a* held by the movable contactor holder 22 separates from the normally open fixed contact 25-1*a*, the normally closed movable contact 26-2*b* and the normally closed fixed contact 25-2*b* are closed, and the opening-closing contact portion becomes an opening-closing state at the time of the standby state.

When the switch unit 20 and the operation unit 10 are separated from each other from the joined state thereof, the operations may be performed according to a procedure reversed with respect to the joining procedure illustrated by FIGS. 9(*a*)-9(*d*). However, unless the rotary cover 31 is pushed down to a position at which the protrusion 31*c* overlaps the protrusion 32*c* of the rotary drive plate 32 in the state shown in FIG. 9(*d*), the rotary cover 31 cannot be rotated, therefore, it is necessary to perform the operation of pushing down the rotary cover 31.

In the switch device 1 depicted in FIG. 1, the operation unit 10 is thus joined to the switch unit 20 and placed in the standby state. In this state, the rotary drive plate 32 of the rotary drive portion 30 pushes the pressure-receiving piece 22*a* of the movable contactor holder 22 of the switch unit 20 at a position with a small height H1 of the cam piece 32*a*. Therefore, the rotary drive plate 32 is in a standby position at which the movable contactor holder 22 is pushed up. As a result, the normally open movable contact 26-1*a* and the normally open fixed contact 25-1*a* are separated from each other and become the switch-off state, and the normally closed movable contact 26-2*b* and the normally closed fixed contact 25-2*b* are closed and become the switch-on state.

Figure 11:
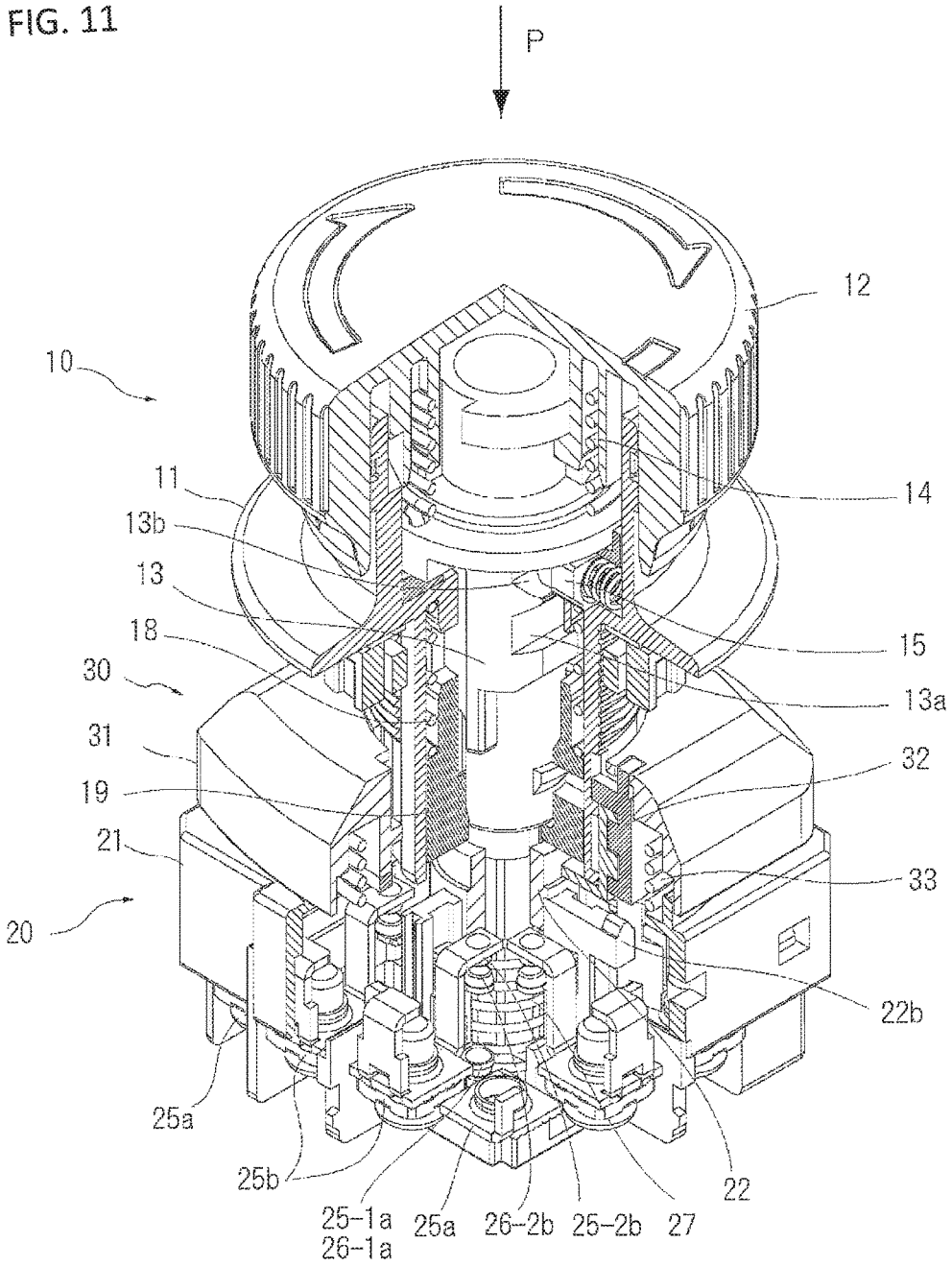
FIG. 11 is a partially cut-out perspective view illustrating the operation state of the switch device of the present embodiment.
Figure 12:
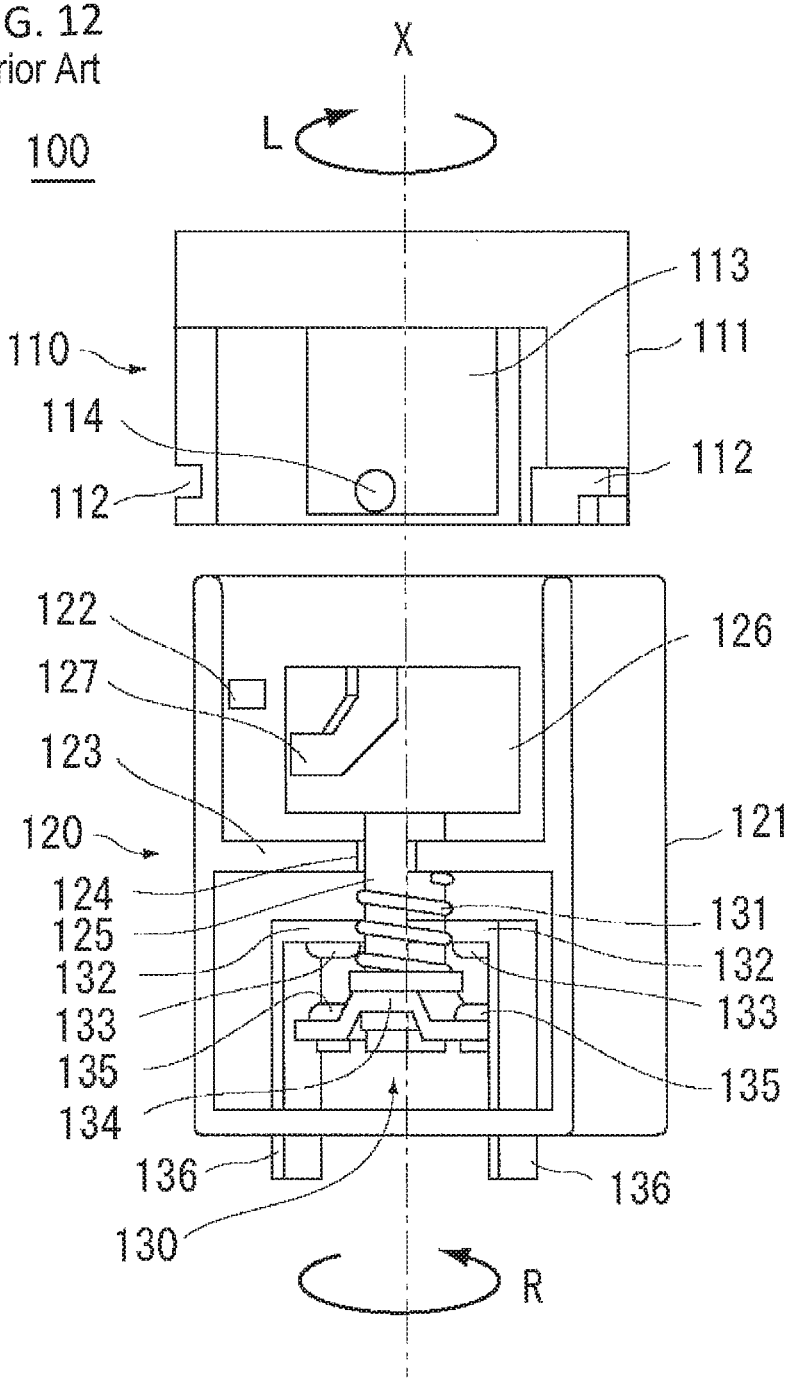
FIG. 12 Prior Art
FIG. 12 is a diagram of the conventional switch device.
Figure 13A:
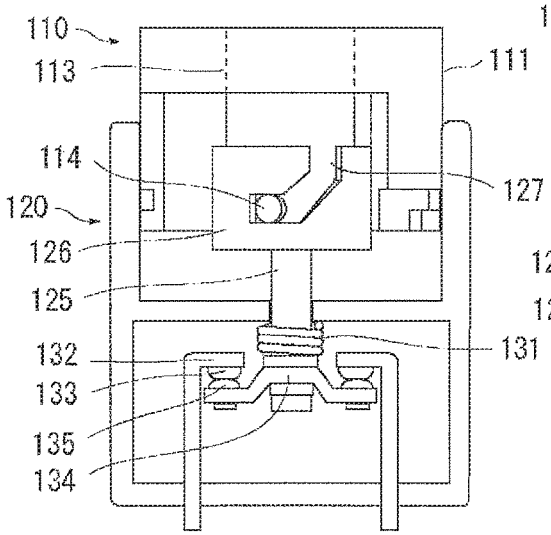
FIG. 13(a) Prior Art
FIGS. 13(*a*), 13(*b*) are explanatory drawings of the operation state of the conventional switch device.
Figure 13B:
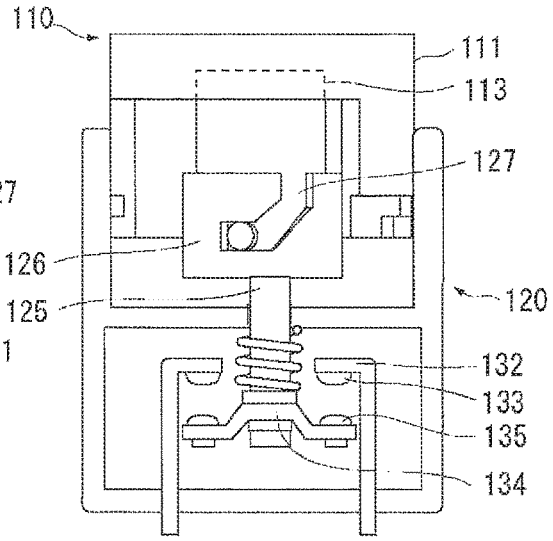
FIG. 13(b) Prior Art
Figure 14:
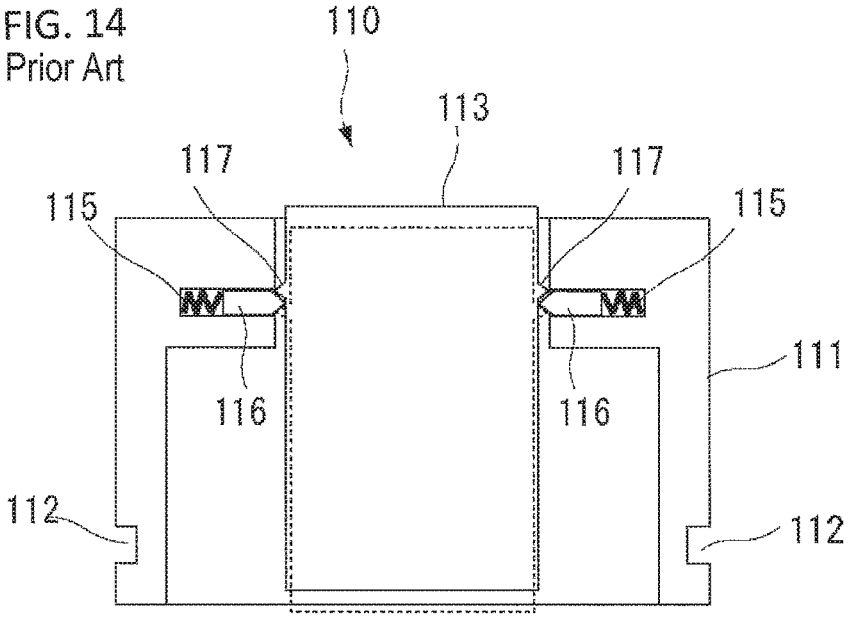
FIG. 14 Prior Art
FIG. 14 is a diagram illustrating the operation unit of the conventional switch device.

When the pushbutton 12 of the operation unit 10 is pushed in the direction of an arrow P, as depicted in FIG. 11, the push rod 13 is pushed down in response thereto. Therefore, the lock pin 15 rides over a step 13*c* located between the two recesses of the push rod 13 joined to the pushbutton 12, engages with the upper recess 13*b*, and holds the pushbutton 12 at the pushing operation position. In response to the downward pushing of the push rod 13, the push body 19 is pushed down through the trigger spring 18. As a result, the upper end of the movable contactor holder 22 of the switch unit 20 abutting against the push body 19 is pushed down against the urging force of the contact spring 27. Therefore, the normally open movable contact 26-1*a* and the normally open fixed contact 25-1*a* are closed and become the switch-on state, and the normally closed movable contact 26-2*b* and the normally closed fixed contact 25-2*b* are separated from each other and become the switch-off state. This is the opening-closing state of the opening-closing contact mechanism at the time the operation unit 10 is in the pushing operation state.

In order to return the switch device 1 in such an operation state to the standby state such as depicted in FIG. 1, the pushbutton 12 is turned in the direction of the arrow displayed on the surface of the pushbutton 12 and the locked state caused by the lock pin 15 is released.

Figure 5A:
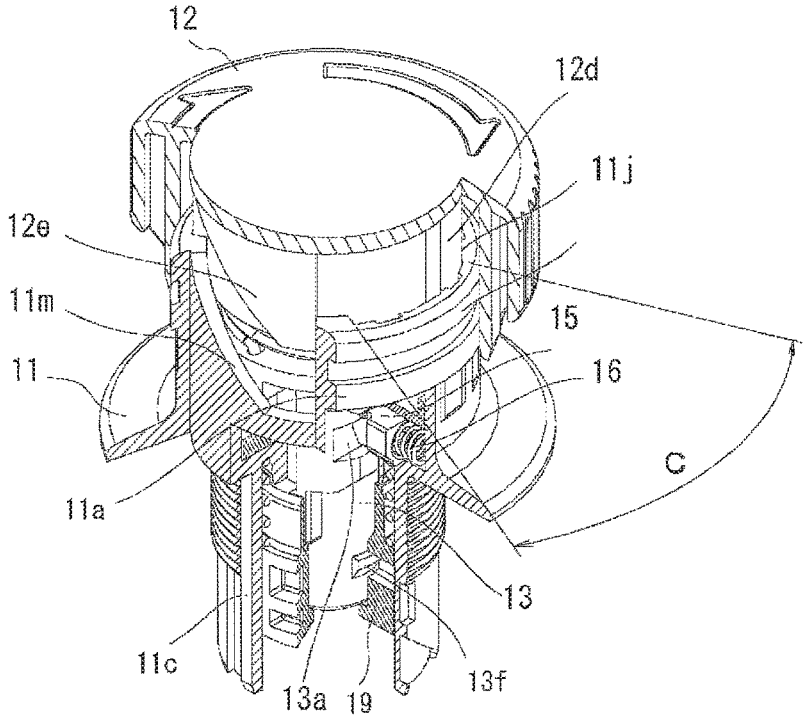
FIGS. 5(*a*), 5(*b*) illustrate the operation of the operation unit of the present embodiment, wherein FIG. 5(*a*) is a partially cut-out perspective view illustrating the locked state at the standby position, and FIG. 5(*b*) is a partially cut-out perspective view illustrating the locked state at the pushing operation position.
Figure 5B:
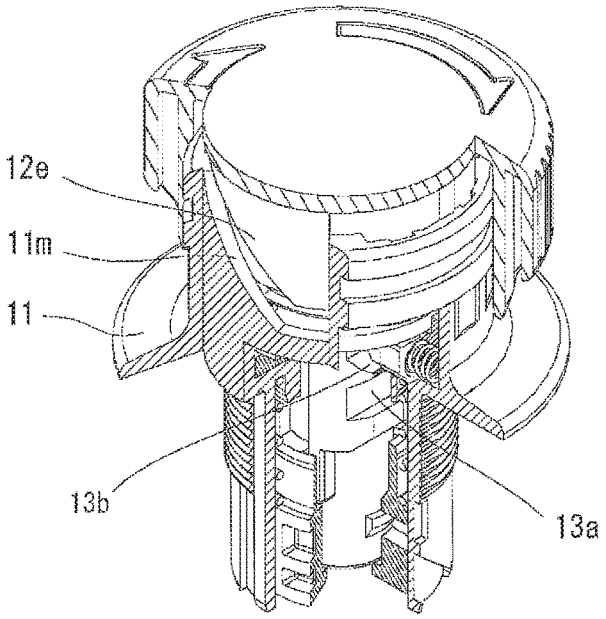

In order to facilitate such an operation of releasing the locked state, as shown in FIG. 5, cam portions 11*m* and 12*e* having inclined surfaces that rise from right to left along the circumference are provided facing each other on the inner circumference of the operation unit main body 11 of the operation unit 10 and the outer circumference of the inner wall of the pushbutton 12 facing thereto.

In the standby state before the pushing operation of the pushbutton 12, the lock pin 15 is engaged with the recess 13*a* in the lower part of the push rod 13 joined to the pushbutton 12, as depicted in FIG. 5(*a*), and the locked state is maintained. Therefore, the pushbutton 1 is at the push-up position, and the cam portion 11m of the operation unit main body 11 is separated from the cam portion 12*e* of the pushbutton 12.

In the operation state in which the pushbutton 12 has been pushed, the lock pin 15 engages with the recess in the upper part of the push rod 13 and the locked state is maintained. Therefore, the pushbutton 12 is at the push-down position, the cam portion 12*e* of the pushbutton 12 approaches the cam portion 11*m* of the operation unit main body 11, and practically no gap is present therebetween.

When the pushbutton 12 is rotated from this state to the right in the preset range of rotation angle C described hereinabove, the cam surface of the cam portion 12*e* of the pushbutton 12 comes into contact with the cam surface of the cam portion 11*m* of the operation unit main body 11 and is pushed up along this cam surface. The push rod 13 rises accordingly, and the recess 13*a* located in the lower part thereof engages with the lock pin 15 and returns to the original standby position.

When the locked state at the operation position created by the lock pin 15 is thus released, the movable contactor holder 22, the push rod 13, and the pushbutton 12 are pushed by the restoration forces of the contact spring 27 and the trigger spring 18, and returned to the position of the standby state. The pushbutton 12 is returned to the original rotation position by the twisted return spring 14 and becomes the standby state depicted in FIG. 1.

If by any chance an accident occurs such that the switch unit 20 of the switch device 1 separates from the operation unit 10, as depicted in FIG. 10(*a*), since the operation unit 10 and the rotary drive portion 30 are not joined together anymore, the rotary drive portion 30 is rotated to the right, as shown by the arrow R, by the restoration force of the internal rotary return spring 33 and returns to the standby position depicted in FIG. 10(*a*). At the same time, the rotary drive plate 32 located inside the rotary drive portion is also rotated. Therefore, the cam piece 32*a* applies pressure to the pressure-receiving piece 22*a* of the movable contactor holder 22 at a position with a large height Hh of the cam piece 32*a*. As a result, the movable contactor holder 22 is pushed downward. Therefore, the normally closed movable contact 26-2*b* and the normally closed fixed contact 25-2*b* are separated from each other and become the switch-off state, the normally open movable contact 26-1*a* and the normally open fixed contact 25-1*a* are closed and become a switch-on state, and the opening-closing contact mechanism becomes the state same as the opening-closing state at the time the operation unit is in the operation state. Therefore, the switch device can be used as an emergency safety switch.

In the switch device 1 of the invention, in a state in which the rotary drive portion 30 is placed at the usage position and the pushbutton 12 is in the standby state, as depicted in FIG. 1, the movable contacts of the opening-closing contact portion of the switch unit 20 are urged by the contact spring 27 in the direction of separating the opening-closing portion of the (a) contact and in the direction of closing the opening-closing portion of the (b) contact. Therefore, even when an impact force is applied to the switch device in this state, an erroneous operation such that closes the opening-closing portion of the (a) contact and separates the opening-closing portion of the (b) contact cannot occur. As a result, the operation reliability can be increased.

EXPLANATION OF REFERENCE NUMERALS

1—switch device, 10—operation unit, 11—operation unit main body, 12—pushbutton, 13—push rod, 20—switch unit, 21—switch unit main body, 22—movable contactor holder, 25-1*a*—normally open fixed contact; 25-2*b*—normally closed fixed contact, 26-1*a*—normally open movable contact, 26-2*b*—normally closed movable contact, 27—contact spring, 30—rotary drive portion, 31—rotary cover, 32—rotary drive plate, 32*a*—cam piece, 33—rotary return spring

What is claimed is:

1. A switch device comprising:

an operation unit; and a switch unit detachably attached to the operation unit, and having an opening-closing contact mechanism and a first urging member urging the opening-closing contact mechanism to a closed condition, the switch unit operating the opening-closing contact mechanism to an open condition in association with an operation of the operation unit, wherein the switch unit includes a drive portion driving the opening-closing contact mechanism to the open condition at a standby position where the operation unit is detached from the switch unit and to the closed condition at a usage position where the operation unit is engaged to the switch unit, the operation unit includes a first engagement portion, when the operation unit is engaged to the switch unit, engaging the drive portion to drive the drive portion from the standby position to the usage position, and the driving portion includes a second engagement portion engaging the first engagement portion, and a second urging member urging the second engagement portion to the first engagement portion in a direction orthogonal to an urging direction of the first urging member, when the operation unit is engaged to the switch unit.

2. The switch device according to claim 1, wherein the drive portion includes a cam driving between the standby position and the usage position, and regulating the opening-closing contact mechanism urged by the first urging member.

3. The switch device according to claim 1, wherein the second urging member includes a return spring returning the drive portion from the usage position to the standby position when the switch unit is detached from the operation unit.

4. The switch device according to claim 1, wherein the first urging member includes a contact spring urging an opening-closing contact of the opening-closing contact mechanism in a direction to the closed condition.

5. The switch device according to claim 1, wherein the second urging member is arranged such that the driving portion is urged in an axial direction and a rotation direction of the driving portion.

6. The switch device according to claim 5, wherein the switch unit further includes a switch unit main body, and the drive portion is supported on the switch unit main body, and the second urging member has one end connected to the switch unit main body and another end connected to the drive portion, and the first urging member is arranged between the switch unit main body and the opening-closing contact mechanism.

7. A switch device comprising:

an operation unit; and a switch unit detachably attached to the operation unit, and having an opening-closing contact mechanism and a first urging member urging the opening-closing contact mechanism to a closed condition, the switch unit operating the opening-closing contact mechanism to an open condition in association with an operation of the operation unit, wherein the switch unit includes a drive portion driving the opening-closing contact mechanism to the open condition at a standby position where the operation unit is detached from the switch unit and to the closed condition at a usage position where the operation unit is engaged to the switch unit, the operation unit includes a first engagement portion, when the operation unit is engaged to the switch unit, engaging the drive portion to drive the drive portion from the standby position to the usage position, the driving portion includes a second engagement portion engaging the first engagement portion, and a second urging member urging the second engagement portion to the first engagement portion in a direction crossing an urging direction of the first urging member, when the operation unit is engaged to the switch unit, and the first engagement portion includes an engagement groove provided at the operation unit and inclined in an axial direction, and the second engagement portion includes an engagement protrusion provided at the drive portion and engaging the engagement groove when the operation unit is engaged to the switch unit.

8. A switch device comprising:

an operation unit including:

a pushbutton, a push rod slidably arranged under the pushbutton, and engaging the pushbutton to move together with the pushbutton, a pushbutton return spring arranged between the pushbutton and the push rod to relatively move and urge the pushbutton and the push rod away from each other, and an operation unit main body slidably supporting the push rod and the pushbutton, and having a hole portion in which the push rod is inserted, a switch unit detachably attached to the operation unit, and having an opening-closing contact mechanism and a first urging member urging the opening-closing contact mechanism to a closed condition, the switch unit operating the opening-closing contact mechanism to an open condition in association with an operation of the operation unit, wherein the switch unit includes a drive portion driving the opening-closing contact mechanism to the open condition at a standby position where the operation unit is detached from the switch unit and to the closed condition at a usage position where the operation unit is engaged to the switch unit, the operation unit main body includes a first engagement portion, when the operation unit is engaged to the switch unit, engaging the drive portion to drive the drive portion from the standby position to the usage position, the driving portion includes a second engagement portion engaging the first engagement portion, and a second urging member urging the second engagement portion to the first engagement portion in a direction crossing an urging direction of the first urging member, when the operation unit is engaged to the switch unit, the drive portion is rotatably attached to the opening-closing contact mechanism, and rotates relative to the opening-closing contact mechanism to drive the opening-closing contact mechanism, and the first engagement portion and the second engagement portion are slidably engaged each other, and at the usage position, when the pushbutton is pushed to move the push rod toward the switch unit, the opening-closing contact mechanism is opened in association with movement of the push rod.

9. The switch device according to claim 8, further comprising a lock pin arranged inside the operation unit main body, and retractably protruding to the hole portion of the operation unit main body to hold the push rod, wherein the push rod further includes a first recess and a second recess above the first recess, and the lock pin is engaged in the first recess when the operation unit main body is engaged to the switch unit, and is engaged in the second recess when the pushbutton is pushed to move the push rod toward the switch unit.

10. The switch device according to claim 9, wherein the drive portion includes a rotary drive plate rolatably arranged on the opening-closing contact mechanism, a rotary cover covering the rotary drive plate and engaging the rotary drive plate to move together with the rotary drive plate, and a rotary drive spring, as the second urging member, arranged between the rotary cover and the opening-closing contact mechanism, and urging the drive portion to be positioned at the standby positon.

11. The switch device according to claim 10, wherein the rotary drive plate includes a cam piece protruding from a lower end of the rotary drive plate toward the opening-closing contact mechanism, and having a cam surface inclined upwardly from one end portion to another end portion thereof; and the opening-closing contact mechanism includes a pressure-receiving piece protruding upwardly to contact the cam surface, and at the standby position, the pressure-receiving piece contacts the one end portion of the cam surface of the cam piece to drive the opening-closing contact mechanism to the open condition, and at the usage position, the pressure-receiving piece contacts the another end portion of the cam surface of the cam piece to drive the opening-closing contact mechanism to the closed condition.

12. The switch device according to claim 11, wherein the rotary cover and the rotary drive plate include a first protrusion and a second protrusion, respectively protruding inwardly to form an engagement protrusion as the second engagement portion; and the operation unit main body includes an engagement groove, as the first engagement portion, formed on an outer circumference of a lower portion of the operation unit main body to engage the engagement protrusion, and having an inclined portion inclined relative to an axial direction of the operation unit main body; and when the engagement protrusion moves along the inclined portion to engage the operation unit and the switch unit, the rotary cover and the rotary drive plate integrally rotate against an urging force of the rotary drive spring such that the cam surface contacts the pressure-receiving piece at the another end portion to drive the opening-closing contact mechanism to the closed condition.

* * * * *